United States Patent [19]

Lakic

[11] Patent Number: 4,756,095

[45] Date of Patent: Jul. 12, 1988

[54] FOOTWARMER FOR SHOE

[76] Inventor: Nikola Lakic, 73-355 Guadalupe Ave. #M, Palm Desert, Calif. 92260

[21] Appl. No.: 877,503

[22] Filed: Jun. 23, 1986

[51] Int. Cl.[4] ..... A43B 7/02; A43B 13/28; A43B 21/32

[52] U.S. Cl. ..... 36/2.6; 36/27; 36/28; 36/37

[58] Field of Search ..... 36/2.6, 27, 28, 38, 36/7.8, 37

[56] References Cited

U.S. PATENT DOCUMENTS

| | | | |
|---|---|---|---|
| 382,681 | 5/1888 | Batter | 36/2.6 |
| 418,922 | 1/1890 | Minahan | 36/37 |
| 1,272,931 | 7/1918 | Etheridge | 36/2.6 |
| 2,442,026 | 5/1948 | Thompson, Jr. | 36/2.6 |
| 2,475,092 | 7/1949 | Harrell | 36/7.8 |
| 3,493,986 | 2/1970 | Erwin | 36/2.6 X |

FOREIGN PATENT DOCUMENTS

| | | | |
|---|---|---|---|
| 180866 | 1/1955 | Austria | 36/2.6 |
| 620963 | 10/1935 | Fed. Rep. of Germany | 36/28 |
| 701420 | 1/1931 | France | 36/2.6 |
| 443571 | 2/1936 | United Kingdom | 36/28 |

*Primary Examiner*—James Kee Chi

*Attorney, Agent, or Firm*—Plante Strauss Vanderburgh

[57] ABSTRACT

There is disclosed a resilient spring and lever support for an inner sole of a shoe which can be used in combination with a new foot warmer mechanism, or can be used as an orthopedic foot support. The preferred embodiment is a foot warmer mechanism which has a pair of sole plates in rubbing frictional contact with the upper sole plate pivotally secured at the toe of the shoe and the lower sole plate supported by a lever arm located near the heel of the shoe. A resilient spring is provided at the heel of the shoe to bias the pair of plates upwardly, and one or more springs can also be provided at intermediate positions. The pair of plates is moved down and up by the applied weight of the wearer and the countering bias of the spring. As the sole plates are moved, they slide against each other, generating heat by friction, to warm the weater's foot. The mechanism can be constructed in the shoe or can be a separate assembly that can be inserted into a shoe.

20 Claims, 5 Drawing Sheets

FOOTWARMER FOR SHOE

BACKGROUND OF THE INVENTION

1. The Field of the Invention

This invention relates to a warming device for shoes and in particular to a simple device for generating heat within a shoe during normal activities.

2. Brief Statement of the Prior Art

In my parent application, Ser. No. 849,024, filed Apr. 7, 1986, now U.S. Pat. No. 4,674,199, I have disclosed a footwarmer mechanism which is incorporated in a shoe. The device illustrated in my parent application utilizes electrical generators which are driven by the up and down movement of a person's foot within the shoe to generate an electrical current which is passed through a resistance heater within the shoe.

While the aforementioned mechanism is effective in warming a shoe, a less complex mechanism is desired to reduce the costs of a mechanism which uses electrical generators. It is also desirable to provide a mechanism which can be used as a subassembly which can be inserted in any shoe, thus not requiring a shoe construction of a particular limitation.

BRIEF STATEMENT OF THE INVENTION

This invention is an internal warming mechanism for a shoe and can include a shoe with the warming mechanism or can be a sub-assembly for incorporating in a shoe. The warming mechanism includes a pair of sole plates which are mounted for relative sliding motion in the shoe. The pair of sole plates are mounted in juxtaposition and are in sliding, frictional contact with each other. The upper sole plate is pivotally mounted at the toe of the shoe and the lower sole plate is pivotally mounted on a support arm located near the heel of the shoe, thereby adapting it for reciprocal longitudinal motion. The pair of sole plates are resiliently biased upwardly by spring means so that the assembly of sole plates raises and lowers in the shoe in response to the application of the weight of the wearer during normal walking and running activities. The heat generated by the frictional rubbing of the opposed surfaces of these sole plates is released within the shoe and warms the wearer's foot.

BRIEF DESCRIPTION OF THE DRAWINGS

The invention will be described with reference to the Figures of which.

DESCRIPTION OF THE PREFERRED EMBODIMENT

Figure 1:
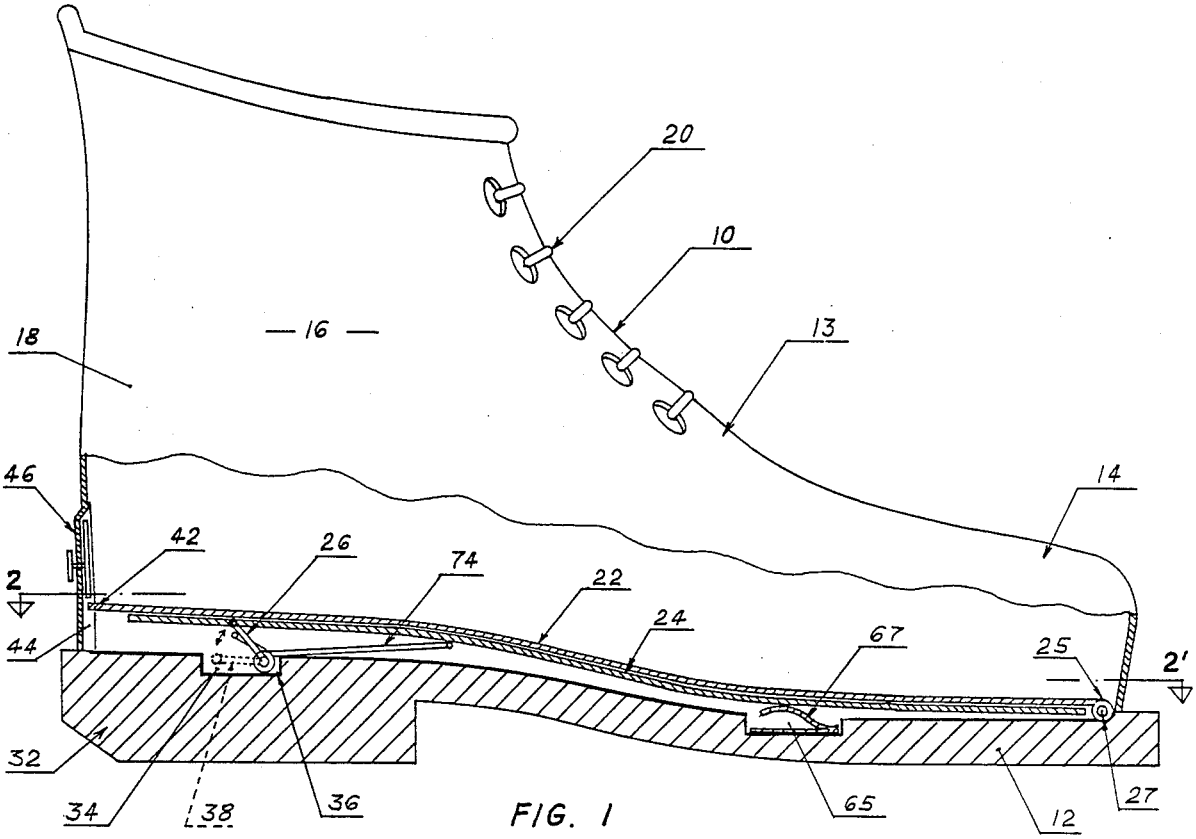
FIG. 1 is an elevational view, partially in cross-section, of a shoe with the foot warmer of the invention.

The invention will be described with reference to FIG. 1 which illustrates a shoe that includes the footwarmer mechanism of the invention. The shoe is illustrated in partial cross-section. Externally the shoe of the invention is insignificantly different from a conventional shoe. The shoe 10 has a conventional sole 12 which is formed in subassembly to an upper portion 13 with conventional assembly techniques, e.g., sewing, gluing, etc. The upper portion 13 includes a toe cover portion 14, side panels such as 16, and preferably an anklet portion 18, all of which are laced together with conventional lacing 20. The specific application illustrated is with reference to a ski boot, however the invention is equally applicable to any other foot apparel.

Internally, the shoe has a sole plate 22 which is pivotally mounted in the toe by hinge 25 having a hinge pin 27. The upper sole plate 22 rests against a lower sole plate 24 which is coextensive therewith. The two upper and lower sole plates 22 and 24, respectively, are thus in juxtaposition and their opposed surfaces are in frictional bearing contact throughout their entire length. The lower sole plate 24 is attached in the assembly by lever arm 26. The upper end of lever arm 26 is pivotally secured to the lower sole plate 24 in a manner described hereinafter in greater detail with reference to FIGS. 3–5. The lever arm 26 is pivotally mounted within a recess 34 in heel 32 of shoe. For this purpose, lever arm 26 has its upper end pivotally secured to the lower sole plate and its lower end pivotally mounted to the bottom forward corner 36 of the recess 34 in heel 32. As shown in FIG. 1, the lever arm 26 is shown in phantom lines in its folded or depressed position 38. The lever arm 26 is biased upwardly by a spring which has a forward arm 74 which is also biased upwardly under the arch portion of the sole plates. If desired, another supplemental spring 67 can be provided at a forward portion of the sole 12, and a recess 65 can be provided to receive the spring 67.

Figure 2:
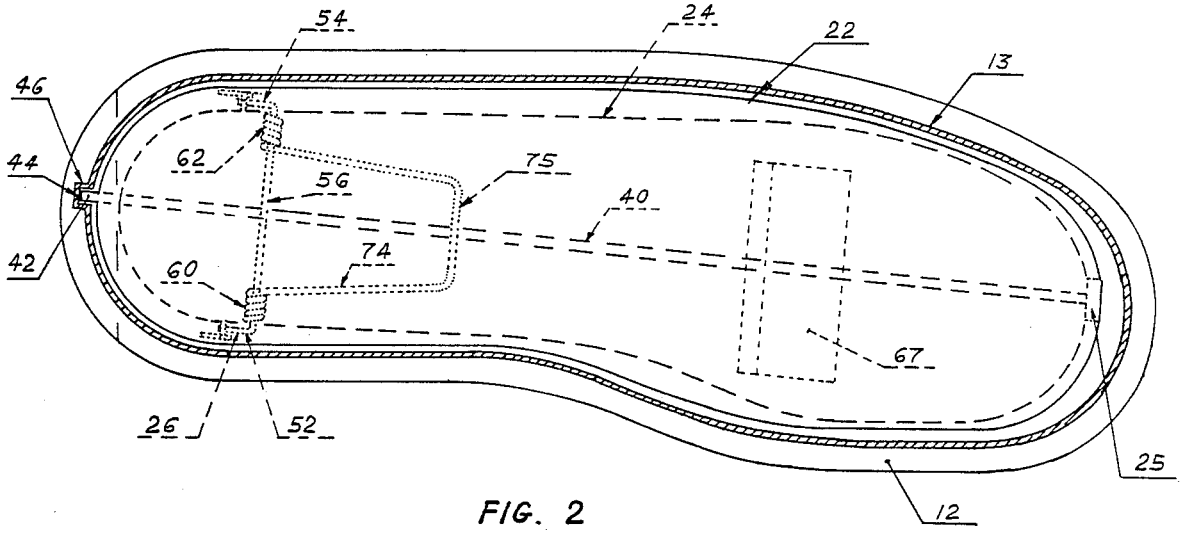
FIG. 2 is a view along line 2–2' of FIG. 1.

Referring now to FIG. 2, the shoe is shown in sectional view along lines 2–2' of FIG. 1. As there illustrated, the upper sole plate 22 is coextensive with the length of the sole 12 and is pivotally mounted by the hinge 25 at the most forward end of the toe portion 14 of the shoe. The upper sole plate 22 is also substantially laterally coextensive the width of the sole 12. The lower sole plate 24 is shown in phantom lines and extends substantially, but not entirely, coextensively with the upper sole plate 24. The lower sole plate 24 is also substantially, but not entirely, laterally coextensive with the upper sole plate. The two sole plates 22 and 24 have centrally located, longitudinal stiffening ribs such as 40. At the rear portion, sole plate 22 and its longitudinal rib 40 have a distal tab 42 which is received within a vertical channel 44 in the internal vertical wall 46 of the shoe.

FIG. 2 also illustrates the lever arm 26 in greater detail. As there illustrated, lever arm 26 is U-shaped with vertical arms 52 and 54 which are distally dependent from a lateral rod portion 56. Since the lever arm 26 supports the sole plates at their opposite sides, it stabilizes the sole plates and prevents them from rocking, side-to-side. As previously mentioned, the mechanism also includes resilient means for upwardly biasing the assembly of upper and lower sole plates. To this end, spring means are provided and the preferred and illustrated means are torsion coil springs 60 and 62 which are received within the recess 34 of heel 32.

Figure 3:
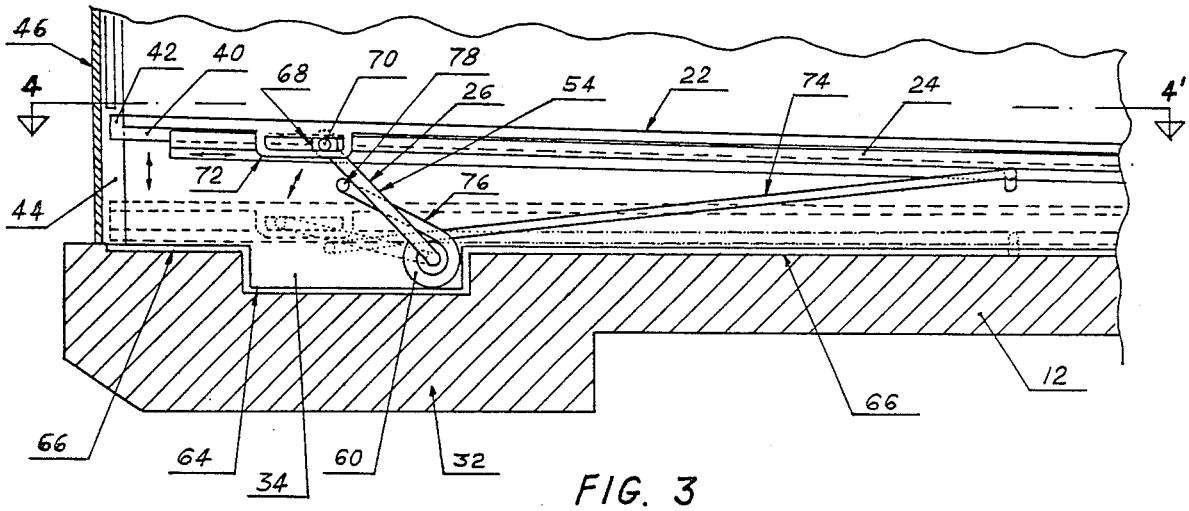
FIG. 3 is an enlarged elevational sectional view of the heel portion of the shoe and footwarmer mechanism.

Referring now to FIG. 3, the mechanism is illustrated in greater detail. FIG. 3 is an expanded vertical sectional view of the heel portion of the shoe. As there illustrated, recess 34 in heel 32 receives a lateral channel 64 of the bottom plate 66 of the mechanism. Plate 66 extends coextensive with the sole 12 of the shoe. The upper and lower sole plates 22 and 24 are shown in their elevated position in solid lines and in their depressed or folded positions in phantom lines. As illustrated, the upper sole plate 22 has a central stiffening rib 40 and has a distal tab 42 which is received within channel 44 of wall 46. The lever arm 26 is shown with its vertical arms 52 and 54 that are pivotally secured to the lower sole plate each by an eyelet 68 which receives a shaft 70 dependent from the lower sole plate. The upper sole plate 22 has a rod bracket 72 dependent from its under surface which slidably receives the shaft 70 of the lower sole plate 24. The resilient spring means of the mechanism is shown as a torsion coil 60 which is received about the transverse rod portion 56 (see FIG. 4) of the lever arm 26. The torsion coil has a forward arm 74 that is received against the undersurface of lower sole plate 24 and a pair of rear arms 76, each of which has a hook end 78 and is received against its respective vertical arm 52 or 54 of the lever arm 26. This structure is shown in greater detail in FIG. 5 which is a sectional view along line 5–5' of FIG. 4. As there illustrated, the upper sole plate 22 has a central stiffening rib 40 which is received in a center channel 41 of the lower sole plate 24. The lower sole plate 24 can have a stiffening rib 43 on its under surface. The upper and lower sole plates are shown in continguous, bearing contact along the interface between the two sole plates.

The lower sole plate has a pair of laterally extending shafts 70 which are received in the aforementioned rod brackets 72 on the undersurface of the upper sole plate. The eyelet 68 of the vertical arms such as 52 of the lever arm 26 receive these shafts to provide pivotal engagement with the lower sole plate 24. As previously mentioned, the transverse rod portion 56 of lever arm 26 is received within the torsion coil springs 60 and 62 of the assembly. This transverse rod portion 56 is also pivotally mounted in the assembly by pivot blocks 80 which are permanently secured to plate 66 at the bottom forward corner of channel 64. As previously mentioned, the vertical arm 76 of each torsion spring has a laterally outwardly bent hook end 78 which is received beneath the upright, respective lever arm such as 52 or 54.

Figure 4:
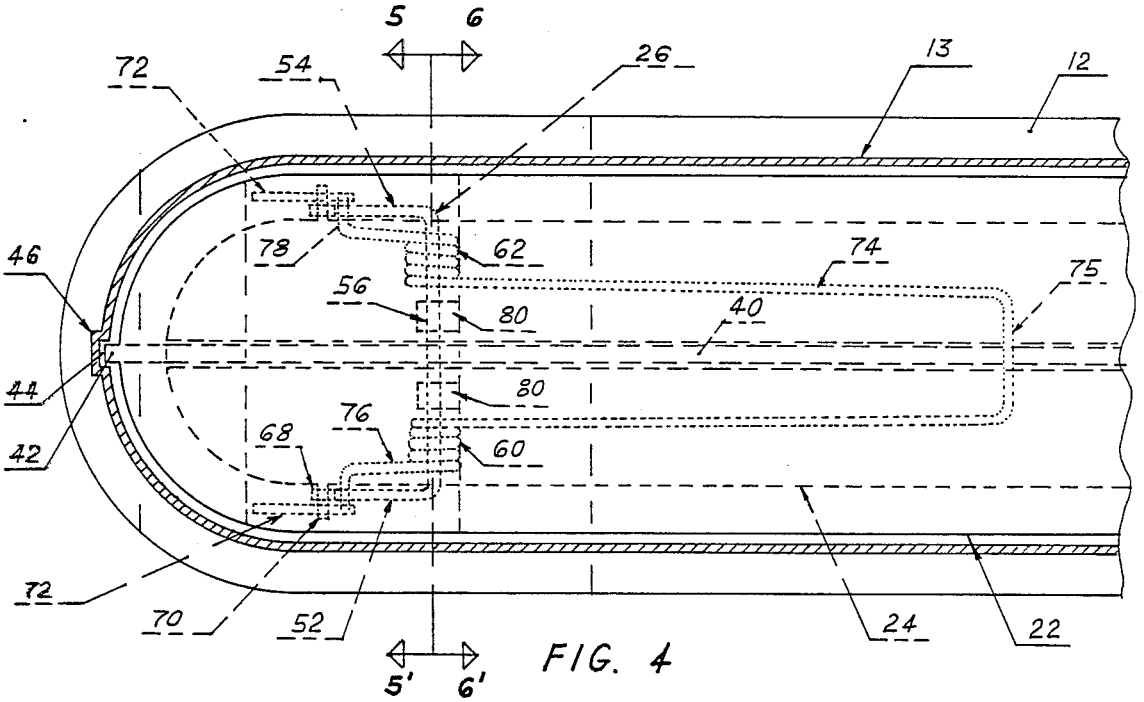
FIG. 4 is a view along line 4–4' of FIG. 3.
Figure 5:
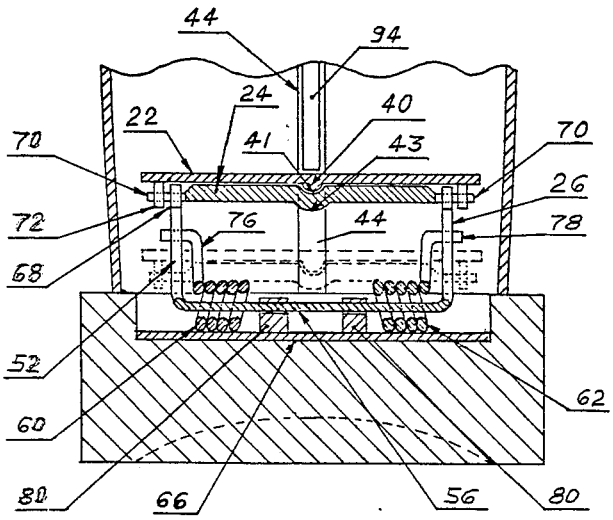
FIG. 5 is a view along line 5–5' of FIG. 4.

Referring now to FIG. 4, the assembly is illustrated in greater detail. FIG. 4 is a view along line 4–4' of FIG. 3 and the lever arm and spring mechanism is shown in phantom lines. As illustrated, the upper sole plate 22 is shown in solid lines with the lower sole plate 24 in phantom lines. The spring means used with the invention includes a pair of torsion coils 62 and 60 which have their forward arm 74 received against the undersurface of lower sole plate 24, and their opposite ends 76 having the laterally projecting portion 78 received against the vertical lever arm 52 and 54. The laterally projecting shafts such as 70 which are integral extensions of the sole plate 24 are received in the distal eyelets of lever arms 52 and 54.

Figure 6:
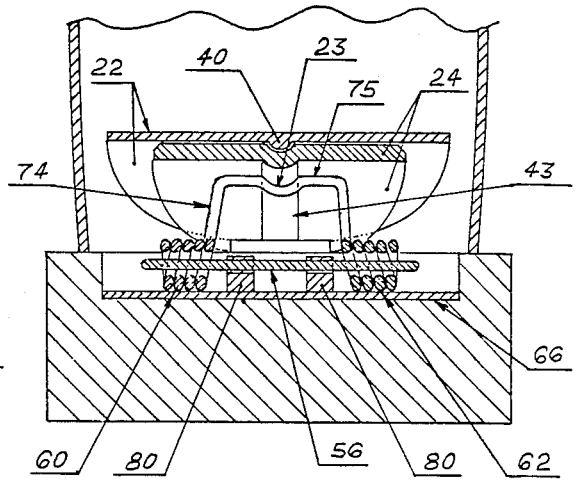
FIG. 6 is a view along line 6–6' of FIG. 4.

Referring now to FIG. 6, the warming mechanism is illustrated in sectional view along lines 6–6' of FIG. 4. As there illustrated, the upper sole plate 22 is juxtapositioned on the lower sole plate 24, and the two plates are in rubbing frictional contact along their mating surfaces. The forward arm 74 of the spring has a lateral crossbar 75 which bears against the undersurface of lower sole plate 24. This crossbar 75 has a center arcuate notch 23 which receives the center stiffening rib 43 of the lower sole plate 24.

Figure 8:
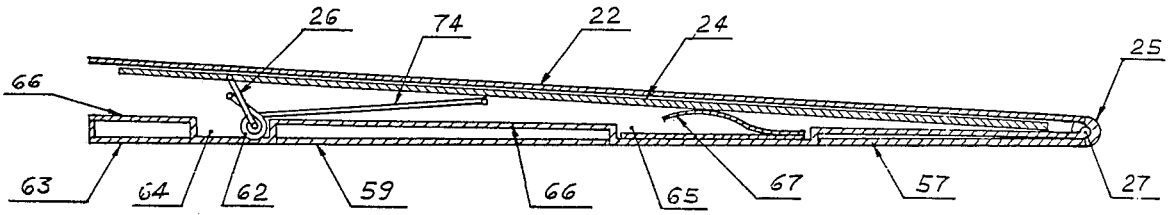
FIG. 8 is a sectional elevational view of the mechanism of FIG. 7.
Figure 7:
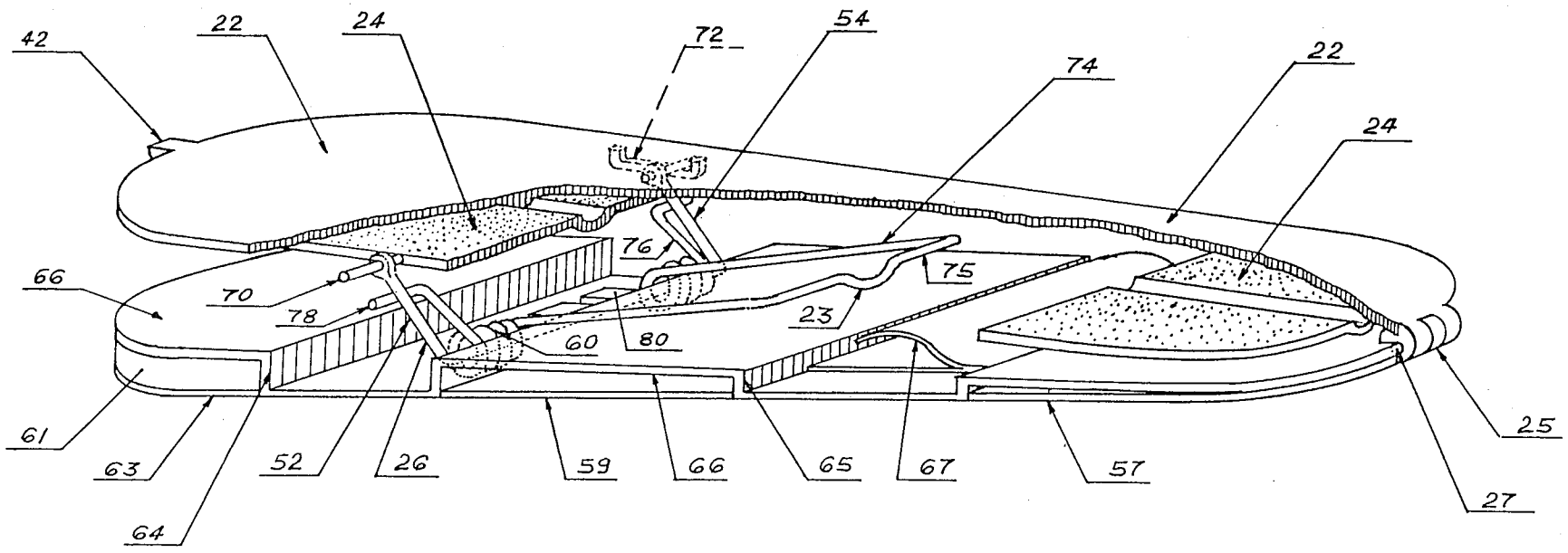
FIG. 7 is a perspective view of an insertible warming mechanism.

The invention can also be provided as an insert for conventional shoes. FIGS. 7 and 8 illustrate a suitable embodiment for this purpose. This insertible device has a bottom plate 66 substantially as previously described with a lower heel plate 63 that provides support for the raised heel portion of plate 66. For this purpose, the channel between heel plate 63 and the heel portion of plate 66 can be filled with a suitable material, e.g., plastic foam 61. The device also has a middle bottom plate 59 which extends between channels 64 and 65 of plate 66. If desired, a bottom toe plate 57 can also be provided. The aforementioned bottom plates can be permanently secured to plate 66 by suitable means, e.g., welding, cement, etc.

The remainder of the insertible device shown in FIGS. 7 and 8 is essentially as that previously described. The device has an upper sole plate 22 in rubbing frictional contact with a lower sole plate 24. Preferably the opposed surfaces of these sole plates bear a roughened, frictional material such as a coating of metal oxides, or organic coatings capable of generating substantial frictional heat when rubbed together. The upper sole plate is pivotally secured to the toe end of plate 66 with hinge 25, and the lower sole plate is attached to plate 66 by the aforementioned lever arm assembly 26 to impart a reciprocal movement to the sole plate 24 as it is depressed. Suitable spring return means in the form of torsion coils 60 and 62 with the forward arm 74 insure that the sole plates rise when the wearer's weight is removed from the heel portion. This resilient return of the sole plates can be assisted by the additional spring means in the form of leaf spring 67 which rests in the forward channel 65 of plate 66. This leaf spring 67 also insures that the middle and forward portion of the sole plates 22 and 24 will constantly be in rubbing, frictional contact.

Figure 9:
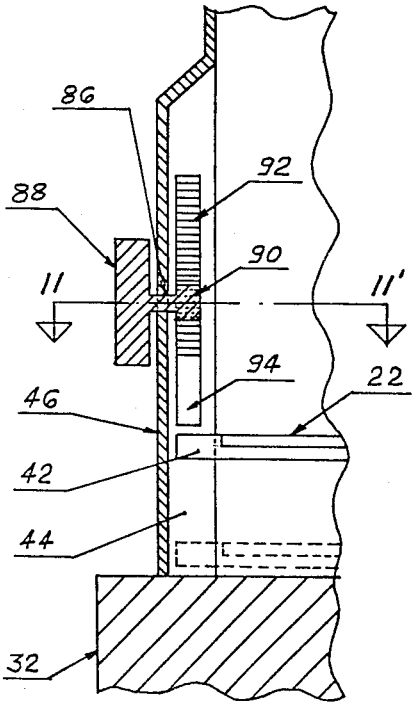
FIG. 9 is an enlarged elevational sectional view of the brake for the mechanism of the invention.
Figure 10:
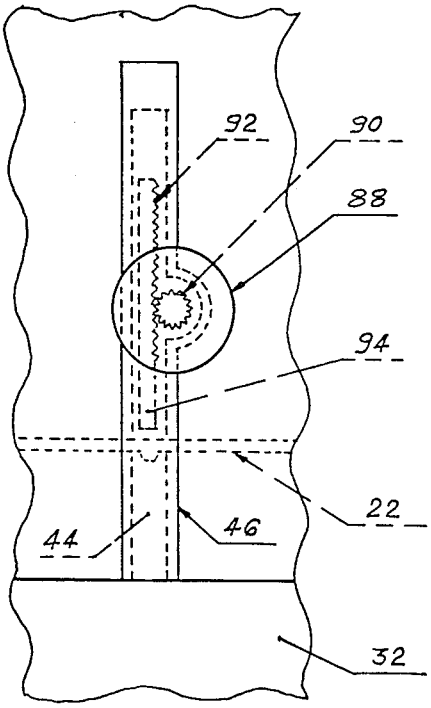
FIG. 10 is a view from the left side of FIG. 9.
Figure 11:
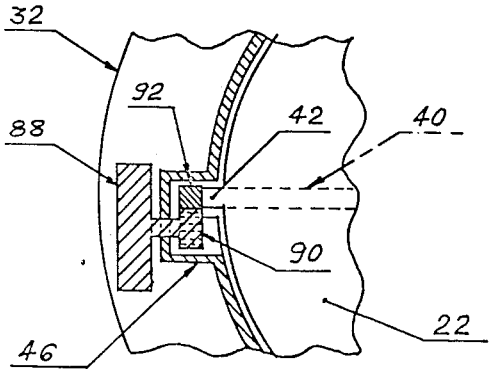
FIG. 11 is a view along line 11–11' of FIG. 9.
Figure 12:
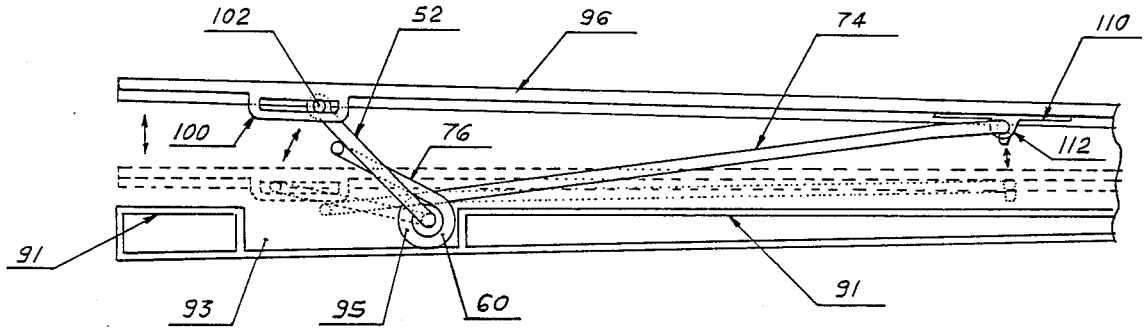
FIG. 12 is a view of an alternative spring mechanism.
Figure 13:
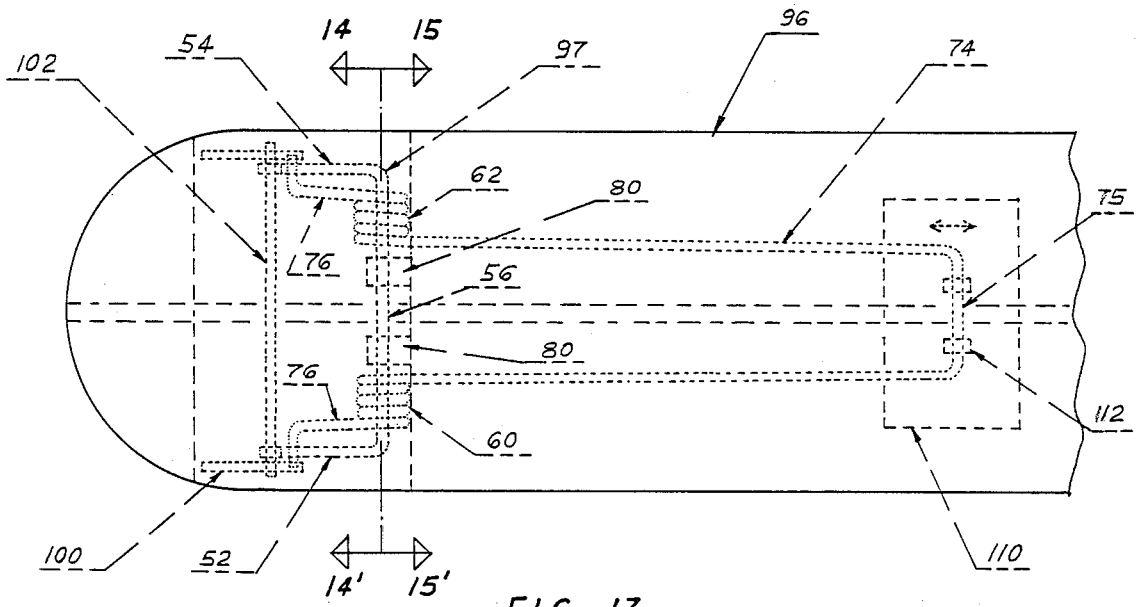
FIG. 13 is a view from the top of FIG. 12.
Figure 14:
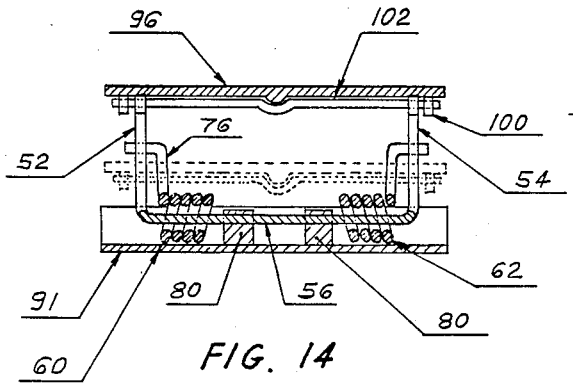
FIG. 14 is a view along line 14–14' of FIG. 13.
Figure 15:
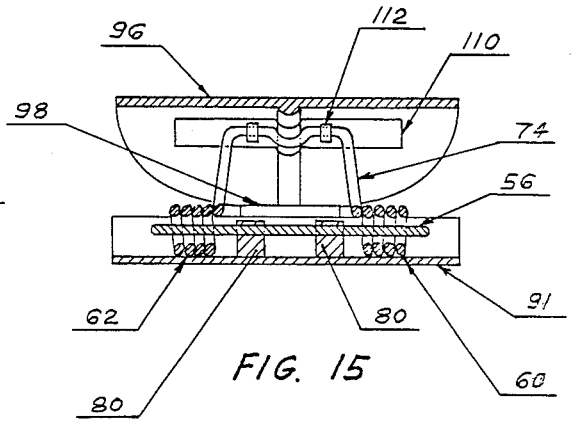
FIG. 15 is a view along line 15–15' of FIG. 13.

Referring now to FIGS. 9–11, the brake mechanism will now be described in greater detail. As previously mentioned, the upper sole plate 24 has a tab 42 which is received in a channel 44 in the rear wall 46 of the shoe. The rear wall 46 has an aperture 86 which rotatably receives a shaft bearing an external thumb wheel 88. On its inner end, the shaft bears a pinion gear 90 which engages a rack 92 of a vertically movable plate 94 (see FIG. 9). The thumb wheel 88 can thus be rotated to drive plate 94 downwardly, by pinion gear 90 and rack 92. This movement compresses the springs 60 and 62 and locks the upper and lower sole plates in the depressed or folded positions shown by the phantom lines.

The spring mechanism of the invention as thus described can also be used without the lower sole plate, to provide an orthopedic construction that will provide a very comfortable, resilient foot support. Such an embodiment is shown in FIGS. 12–15. As there illustrated, the device has a bottom plate 91 with a lateral channel 93 to receive the resilient spring 95. A single sole plate 96 is pivotally attached to the toe end of plate 91 by hinge means 98 (see FIG. 15) which is the same as hinge 25 previously described. The sole plate 96 has slotted brackets 100 at its opposite sides which slidably receive a cross bar 102. The spring 95 and lift arm assembly 97 are identical to those shown in FIGS. 1–7 and the same numbers are used to refer to the elements of these members. The torsion coils 60 and 62 are received over the crossbar 56 with opposite arms 76 which are received against the vertical arms 52 and 54 of the lift arm assembly 97. The lift arm assembly 97 includes a pair of mounting blocks 80 to pivotally attach the lift arms to plate 91. Spring 95 has a forward arm 74 which has a lateral crossbar 75 which is pivotally attached to the underside of support plate 110. Support plate 110 is unattached to sole plate 96 and is urged against the undersurface of the sole plate 96 by spring 95. A pair of brackets 112 pivotally secure the crossbar 75 of spring 95. Support plate 110 provides an expanded bearing surface for spring 95 and is particularly useful in combination with a flexible sole plate 96. The resilient return mechanism such as shown in FIGS. 12–15 can also be used as the return mechanism in my parent application, previously identified.

Figure 16:
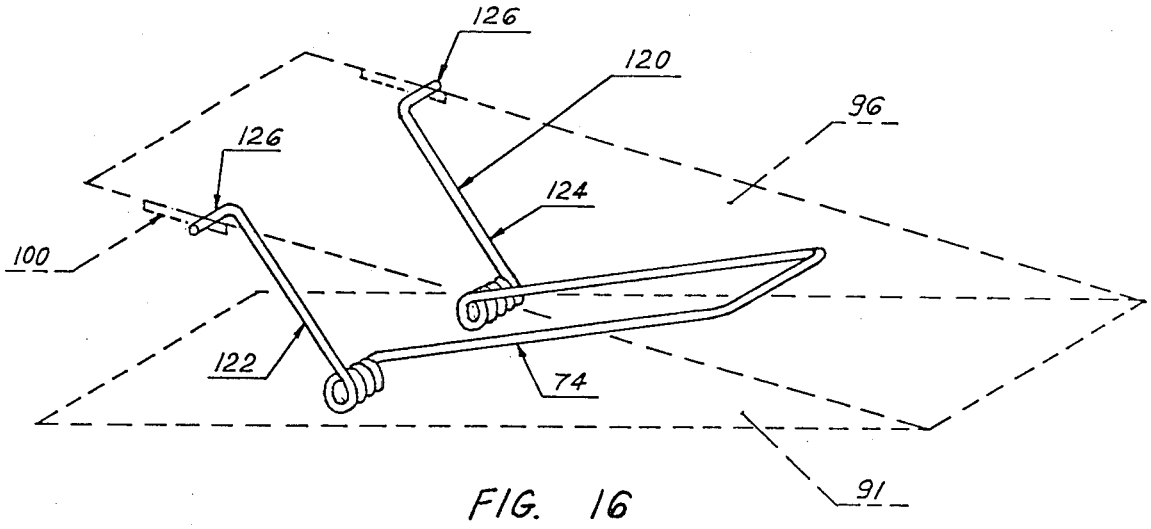
FIG. 16 is a perspective view of the preferred spring.

FIG. 16 illustrates another version of the resilient spring which can be used in this invention as well as in the invention disclosed in my aforementioned parent application. The spring is illustrated in perspective view. In this embodiment, the lift arms are completely replaced with spring 120, which is substantially identical to spring 95 shown in FIGS. 12–15. In this illustration, sole plate 96 and base plate 91 are shown in phantom lines. The slots of brackets 100 are also shown in phantom lines. Spring 120 has extended arms 122 and 124 which have bent ends 126 that are slidably received within the slots of brackets 100. These ends can terminate also in eyelets such as 68 and receive a crossbar such as 102 (see FIGS. 12–14). In this embodiment, a single spring 120 provides the entire lifting mechanism for the sole plate 96. The forward end of spring 120 is resiliently biased against the undersurface of sole plate 96 intermediate its length. This structure can be used to provide a resilient, orthopedic support and can also be used as a resilient return for a foot warmer mechanism such as that shown in FIGS. 1–7 of this application. When used as an orthopedic support, the sole plate 96 can be flexible so the spring arm 74 and plate 110 can provide a very resilient support for the arch of the wearer's foot.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A foot warmer for a shoe which comprises:

a. a first, upper sole plate within said shoe and pivotally secured to the toe end of the sole of said shoe;

b. a second, lower sole plate mounted within said shoe and beneath said upper sole plate and in substantial longitudinal and lateral coextensive, sliding frictional contact with the undersurface thereof;

c. pivotal support means including lever arm means pivotally engaged between said lower sole plate and the sole of said shoe, and located at the rear of said shoe; and d. resilient lift means secured to said pivotal support means to resiliently bias said lower and upper sole plates upwardly, against the applied weight of the wearer of the shoe, whereby said lower sole plate is caused to move in bearing frictional contact against the undersurface of said upper sole plate, generating heat, when said upper and lower sole plates are depressed and released.

2. The foot warmer mechanism of claim 1 wherein said mechanism comprises an assembly adapted to be inserted into a shoe and including a bottom plate, and wherein said upper plate is pivotally attached to the toe end of said bottom plate and said lever arm means is pivotally attached to a mid portion of said bottom plate.

3. The foot warmer mechanism of claim 2 wherein said bottom plate has a lateral channel at is mid portion to provide a recess in which said lever arm means and resilient means is mounted.

4. The foot warmer mechanism of claim 3 wherein said lever arm means is a generally U-shaped rod with a transverse crossbar that is pivotally received in mounting blocks located at the forward bottom corner of said channel.

5. The foot warmer mechanism of claim 4 wherein said lever arm means includes opposite vertical arms, each with a distal grommet and wherein said lower sole plate has cooperative lateral shaft ends which are pivotally received in the respective grommet of said arm means.

6. The foot warmer mechanism of claim 5 wherein said upper sole plate has a pair of slotted brackets on opposite sides of its undersurface, and said lateral shaft ends are slidably received in said brackets.

7. The foot warmer mechanism of claim 1 wherein said resilient means includes a forwardly projecting spring arm that is resiliently biased against the undersurface of said lower sole plate, forward of its pivotal engagement with said lever arm means.

8. The foot warmer mechanism of claim 7 including supplemental leaf spring means mounted to said sole and resiliently biased against the undersurface of said lower sole plate, forward of said forwardly projecting spring arm of said resilient means.

9. The foot warmer mechanism of claim 1 including a longitudinal stiffening rib located centrally on the undersurface of said upper sole plate.

10. The foot warmer mechanism of claim 9 including a mating longitudinal central groove in the upper surface of said lower sole plate in which said stiffening rib of said upper plate is slidably received.

11. The foot warmer mechanism of claim 1 wherein said upper sole plate has a distal tab centrally located at its rear end and wherein said shoe has a mating, vertical channel in its heel wall which receives said distal tab, thereby providing lateral restrain of said upper sole plate.

12. The foot warmer mechanism of claim 11 including brake means mounted in said vertical channel to lock said foot warmer mechanism in its depressed position.

13. The foot warmer mechanism of claim 12 wherein said brake means includes a vertically mounted rack within said channel with a pinon gear engaged therewith and mounted on a shaft extending through the heel wall of said shoe and supporting a thumb wheel on its outer end.

14. The foot warmer mechanism of claim 2 wherein said bottom plate has a smooth undersurface, adapting said mechanism to an insert that can be placed in a shoe.

15. An orthopedic resilient foot support for a shoe which comprises:

a. a sole plate pivotally secured to the toe end of the sole of said shoe;

b. pivotal support means including lever arm means pivotally engaged between said sole plate and the heel portion of the sole of said shoe, and located at the rear of said shoe; and c. resilient lift means secured to said pivotal support means including a rearwardly projecting spring arm and a forwardly projecting spring arm, both of which being resiliently biased against the undersurface of the arch portion of said sole plate, with said rearwardly projecting spring arm resiliently biasing the heel portion of said sole plate upwardly, and said forwardly projecting spring arm extending forward of its pivotal engagement with said lever arm means to resiliently bias said sole plate upwardly, against the applied weight of the wearer of the shoe; and d. supplemental leaf spring means mounted in said sole and resiliently biased against the undersurface of said lower sole plate, forward of said forwardly projecting spring arm of said resilient means.

16. The orthopedic resilient foot support of claim 15 wherein said mechanism includes a bottom plate, and said upper plate is pivotally attached to the toe end of said bottom plate and said lever arm means is pivotally attached to a mid portion of said bottom plate.

17. The orthopedic resilient foot support of claim 16 wherein said bottom plate has a lateral channel at its mid portion to provide a recess in which said lever arm means and resilient means are mounted.

18. The orthopedic resilient foot support of claim 17 wherein said lever arm is a generally U-shaped rod with a transverse crossbar that is pivotally received in mounting blocks located at the forward bottom corner of said channel.

19. The orthopedic resilient foot support of claim 18 wherein said lever arm means includes opposite vertical arms, each with a distal grommet and wherein said sole plate has cooperative lateral shaft ends which are pivotally received in the respective grommet of said arm means.

20. The orthopedic resilient foot support of claim 19 wherein said sole plate has a pair of slotted brackets on opposite sides of its undersurface, and said lateral shaft ends are slidably received in said brackets.

* * * * *